US008482207B2

(12) United States Patent
Sun et al.

(10) Patent No.: US 8,482,207 B2
(45) Date of Patent: Jul. 9, 2013

(54) TEMPERATURE CONTROLLING SYSTEM FOR LED MODULE

(75) Inventors: Sung-Hsien Sun, Sinjhuang (TW); Bor-Haw Chang, Sinjhuang (TW)

(73) Assignee: Asia Vital Components Co., Ltd., Sinjhuang, Taipei County (TW)

( * ) Notice: Subject to any disclaimer, the term of this patent is extended or adjusted under 35 U.S.C. 154(b) by 173 days.

(21) Appl. No.: 12/894,175

(22) Filed: Sep. 30, 2010

(65) Prior Publication Data

US 2012/0081007 A1 Apr. 5, 2012

(51) Int. Cl.
*H01J 7/24* (2006.01)

(52) U.S. Cl.
USPC ..... 315/117

(58) Field of Classification Search
USPC ..... 315/32, 50, 112, 117–118; 353/52, 353/57; 313/10–11, 13
See application file for complete search history.

(56) References Cited

U.S. PATENT DOCUMENTS

| | | | | |
|---|---|---|---|---|
| 6,886,942 | B2 * | 5/2005 | Okada et al. | 353/52 |
| 7,075,596 | B2 * | 7/2006 | Hosoda | 349/72 |
| 7,976,171 | B2 * | 7/2011 | Kameoka et al. | 353/57 |
| 8,107,019 | B2 * | 1/2012 | Shiota | 348/748 |
| 2009/0184619 | A1 * | 7/2009 | Lai | 313/13 |
| 2010/0181833 | A1 * | 7/2010 | Wu | 307/36 |

* cited by examiner

*Primary Examiner* — Minh D A

(57) ABSTRACT

A temperature controlling system for a LED module includes at least one LED unit, at least one fan, at least one temperature sensor and a controlling device. The controlling device generates a driving signal for controlling the rotating speed of the fan based on a temperature detection signal transmitted from the temperature sensor, so that the fan can generate a compulsive airflow for dissipating the heat generated by the LED unit. According to the present invention, the working temperatures of the respective LED units can be kept the same, and a uniform heat-dissipating effect can be achieved.

4 Claims, 2 Drawing Sheets

TEMPERATURE CONTROLLING SYSTEM FOR LED MODULE

BACKGROUND OF THE INVENTION

1. Field of the Invention

The present invention relates to a temperature controlling system for a LED module, and in particular to a temperature controlling system for a LED module, whereby the working temperatures of the respective LED units can be kept the same and a uniform heat-dissipating effect can be achieved.

2. Description of Prior Art

With the advancement of science and technology, light-emitting diodes (referred to as "LED" hereinafter) are advantageous over traditional bulbs in terms of brightness, power, lifetime, electricity consumption and response time, so that the LEDs have been widely used in lamps, signboards and indoor illumination to replace the traditional bulbs.

When a LED lamp is in operation, a plurality of LED units mounted therein generates a great amount of heat due to their poor energy conversion efficiency of electricity to optical energy, so that the heat is accumulated in the LED lamp to make the LED units unstable. As a result, the brightness of the light emitted by the LED units is attenuated and the lifetime of the LED unit is shortened. Therefore, it is an important issue to rapidly dissipate the heat generated by the LED unit to the outside.

A common solution for the heat dissipation of the LED lamp is to provide a plurality of heat-dissipating fins on the rear surface of each LED unit. However, the heat-dissipating effect achieved by the heat-dissipating fins only is so limited that a fan is additionally mounted to the heat-dissipating fins for achieving a compulsive heat-dissipating effect.

Although the heat generated by the LED lamp can be dissipated to the outside by the combination of the heat-dissipating fins and the fan, the heat-dissipating effect achieved by such a combination is still insufficient. As a result, it is unable to dissipate the heat of the respective LED units uniformly due to the temperature and humidity of the ambient environment, so that the degree of heat conduction and heat convection varies throughout the interior of the LED lamp. Thus, the working temperatures of the respective LED units are different from each other, which may reduce the lifetime of some LED units. Further, the brightness of the light emitted by the respective LED units and the attenuation degree of brightness are different from each other.

According to the above, the conventional LED lamp has the following problems: (1) the heat-dissipating effect is not uniform; (2) the lifetime is shortened; and (3) the working temperature and the attenuation degree of brightness of the respective LED units are different from each other.

Therefore, it is an important issue for the present Inventor and the manufacturers in this art to solve the problems in prior art.

SUMMARY OF THE INVENTION

In order to solve the above problems, an objective of the present invention is to provide a temperature controlling system for a LED module, which has a uniform heat-dissipating effect.

Another objective of the present invention is to provide a temperature controlling system for a LED module, whereby the working temperature of the respective LED units can be kept the same.

In order to achieve the above objectives, the present invention is to provide a temperature controlling system for a LED module, including: at least one LED unit having a plurality of LED chips; at least one fan provided on one side corresponding to the LED unit for compulsively dissipating the heat generated by the LED unit; at least one temperature sensor positioned adjacent to the fan, the temperature sensor being configured to detect an ambient temperature of external environment and temperature values around the at least one fan to thereby generate a temperature detection signal; and a control device comprising: an interface circuit electrically connected to the fan and the temperature sensor, a power supply electrically connected to the fan and the LED unit for supplying electricity to the fan and the LED unit, and a microprocessor electrically connected to the interface circuit for generating a driving signal to control the rotating rate of the fan based on the temperature detection signal.

According to the present invention, the LED unit, the fan, the temperature sensor and the control device are integrated into the LED module, so that the working temperature of the respective LED units can be kept the same and a uniform heat-dissipating effect can be achieved.

DETAILED DESCRIPTION OF THE INVENTION

Figure 1:
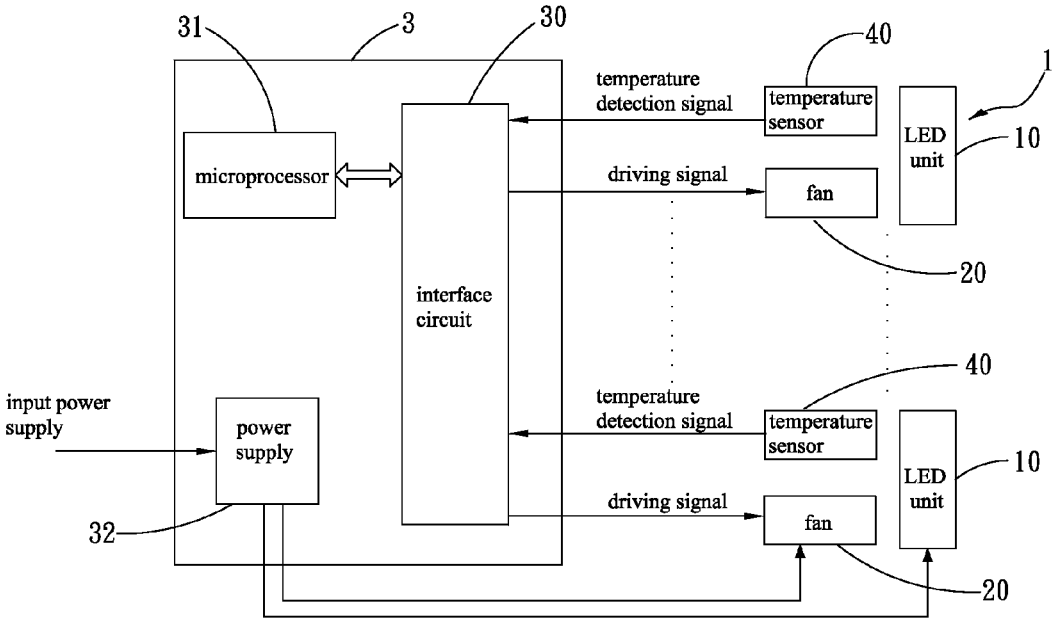
FIG. 1 is a block view showing a preferred embodiment of the present invention.

The above objectives and structural and functional features of the present invention will be described in more detail with reference to preferred embodiment thereof shown in the accompanying drawings Please refer to FIGS. 1 and 2. The present invention is directed to a temperature controlling system for a LED module, which includes at least one LED unit 10, at least one fan 20, at least one temperature sensor 40 and a control device 3. The LED unit 10 has a plurality of LED chips. The LED units 10 constitute a LED module 1. The LED module 1 is mounted in a light-emitting device 5 such as a LED signboard, a LED lamp or the like. In the present embodiment, the light-emitting device 5 is exemplified as a LED lamp, but it is not limited thereto.

The fan 20 is provided on one side corresponding to the LED unit 10 for compulsively dissipating the heat generated by the LED unit 10. The temperature sensor 40 is positioned adjacent to the fan 20 for detecting an ambient temperature of external environment and temperature values of the respective fans 20 to thereby generate a temperature detection signal and for transmitting the temperature detection signal to the control device 3.

Figure 2:
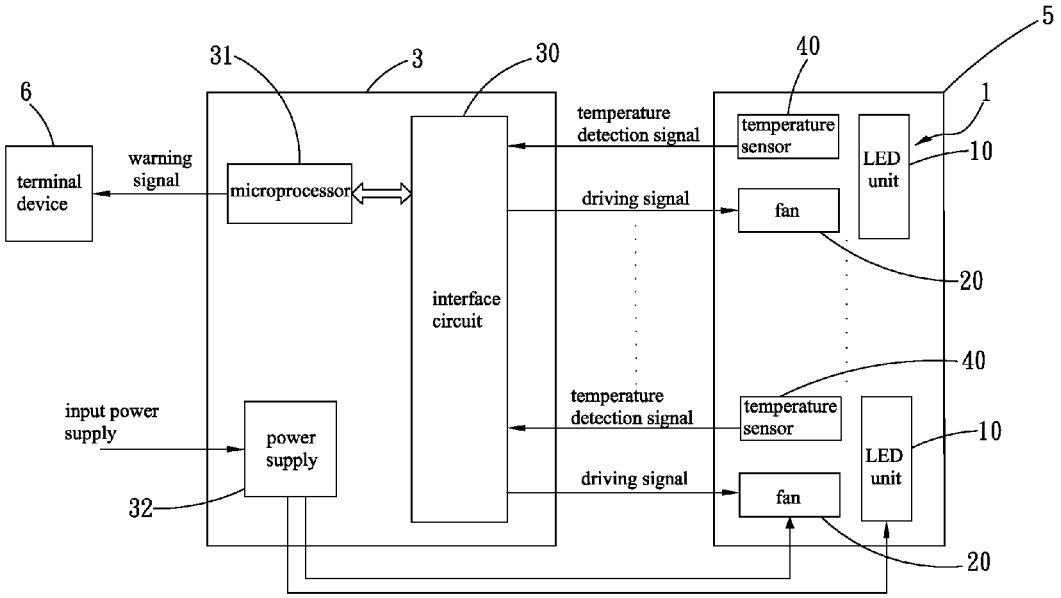
FIG. 2 is a block view showing another preferred embodiment of the present invention.

Further, with reference to FIG. 2, when in use, the user can arrange the fan 20, the temperature sensor 40 and the LED unit 10 in the light-emitting diode 5 based on the internal space and the demand for external appearance of the light-emitting device 5. That is, each LED unit 10 in the light-emitting diode 5 is positioned to correspond to a fan 20, and each fan 20 is positioned adjacent to a temperature sensor 40.

The control device 3 comprises an interface circuit 30, a microprocessor 31 and a power supply 32. The interface circuit 30 is electrically connected to the fan 20, the temperature sensor 40 and the microprocessor 31, and it serves as a medium for transmitting signals among the microprocessor 31, the temperature sensor 40 and the fan 20. For example, the signal generated by the temperature sensor 40 is an analog signal, which is converted by the interface circuit 30 into a digital signal and then transmitted to the microprocessor 31 for subsequent operation.

The power supply 32 is electrically connected to the fan 20, the LED unit 10 and an input power supply for supplying electricity to the fan 20 and the LED unit 10. The microprocessor 31 generates a driving signal based on the temperature detection signal. More specifically, the microprocessor 31 processes the temperature detection signal to generate the driving signal (PWM signal) for controlling the rotating speed of the fan 20. In other words, the microprocessor 31 receives the temperature detection signal via the interface circuit 30 to recognize the temperature value of each portion (i.e., the ambient temperature of external environment and the temperature values around the respective fans 20). Then, the microprocessor 31 transmits the driving signal to the respective fans 20 via the interface circuit 30 to thereby control the rotating speeds of the respective fans 20. In this way, the amount of airflow generated by each fan 20 to each LED unit 10 can be controlled properly, so that the working temperature and the attenuation degree of brightness of the respective LED units 10 can be kept the same. Further, a uniform heat-dissipating effect of the LED module 1 can be achieved.

Further, with reference to FIG. 2 again, the microprocessor 31 has a warning function. That is, the microprocessor 31 detects the temperature value of each portion based on the temperature detection signal and compares the temperature value of each portion with a preset temperature (such as 70° C.). If the temperature value of a certain portion (i.e., the ambient temperature of external environment or one of the temperature values around the respective fans 20) exceeds the preset temperature, the microprocessor 31 will generate a warning signal to a connected terminal device 6. The terminal device 6 shows the portion which is in an abnormal state based on the received warning signal, so that the user can be informed that the fan 20 corresponding to the abnormal portion may suffer damage and a repair is needed.

According to the present invention, since the LED unit 10, the fan 20, the temperature sensor 40 and the control device 3 are integrated into the light-emitting device 5, the amount of airflow generated by the fan 20 can be controlled properly, so that the working temperature and the attenuation degree of brightness of the respective LED units 10 can be kept the same. Further, a uniform heat-dissipating effect of the LED module 1 can be achieved.

Therefore, in comparison with prior art, the present invention has advantageous features as follows:

(1) A uniform heat-dissipating effect is achieved.

(2) The working temperature and the attenuation degree of brightness of the respective LED units can be kept the same Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A temperature controlling system for a LED module, including:

at least one LED unit having a plurality of LED chips;

at least one fan provided on one side corresponding to the LED unit for compulsively dissipating the heat generated by the LED unit;

at least one temperature sensor positioned adjacent to the fan for detecting an ambient temperature of external environment and temperature values around the at least one fan to thereby generate a temperature detection signal; and a control device, comprising:

an interface circuit electrically connected to the fan and the temperature sensor;

a power supply electrically connected to the fan and the LED unity; and a microprocessor electrically connected to the interface circuit for generating a driving signal to control a rotating speed of the fan based on the temperature detection signal;

wherein the microprocessor recognizes the ambient temperature of said external environment and the temperature values around the respective fans based on the temperature detection signal and compares them with a preset temperature, and wherein the microprocessor generates a warning signal to a connected terminal device if the ambient temperature of said external environment and one of the temperature values around the respective fans exceeds a preset temperature.

2. The temperature controlling system for a LED module according to claim 1, wherein the LED units constitutes a LED module.

3. The temperature controlling system for a LED module according to claim 2, wherein the LED module is mounted in a light-emitting device.

4. The temperature controlling system for a LED module according to claim 1, wherein the power supply is electrically connected to an input power source for supplying electricity to the fan and the LED unit.

* * * * *